US011280292B2

(12) United States Patent
Morgenstern et al.

(10) Patent No.: US 11,280,292 B2
(45) **Date of Patent: *Mar. 22, 2022**

(54) METHOD FOR PRODUCING AN ENGINE COMPONENT, ENGINE COMPONENT, AND USE OF AN ALUMINUM ALLOY

(71) Applicant: FEDERAL-MOGUL NURNBERG GMBH, Nuremberg (DE)

(72) Inventors: Roman Morgenstern, Heilsbronn (DE); Stephan Silvio, Nuremberg (DE); Scott Kenningley, Cheshire (GB); Philipp Koch, Nuremberg (DE); Isabella Sobota, Nuremberg (DE); Klaus Lades, Nuremberg (DE); Martin Popp, Nuremberg (DE); Rainer Weiss, Nuremberg (DE); Robert Willard, Nuremberg (DE)

(73) Assignee: Federal-Mogul Nurnberg GmbH, Nuremberg (DE)

( * ) Notice: Subject to any disclaimer, the term of this patent is extended or adjusted under 35 U.S.C. 154(b) by 1321 days.

This patent is subject to a terminal disclaimer.

(21) Appl. No.: 15/313,829

(22) PCT Filed: May 11, 2015

(86) PCT No.: PCT/EP2015/060319

§ 371 (c)(1),
(2) Date: Nov. 23, 2016

(87) PCT Pub. No.: WO2015/173172

PCT Pub. Date: Nov. 19, 2015

(65) Prior Publication Data

US 2017/0226957 A1 Aug. 10, 2017

(30) Foreign Application Priority Data

May 14, 2014 (DE) ..... 102014209102.0

(51) Int. Cl.

| | |
|---|---|
| ***C22C 21/02*** | (2006.01) |
| ***C22C 21/04*** | (2006.01) |
| ***B22D 25/02*** | (2006.01) |
| ***F02F 3/00*** | (2006.01) |
| ***C22C 21/14*** | (2006.01) |
| ***B22D 21/00*** | (2006.01) |
| ***C22C 21/16*** | (2006.01) |

(52) U.S. Cl.
CPC ..... *F02F 3/0084* (2013.01); *B22D 21/007* (2013.01); *B22D 25/02* (2013.01); *C22C 21/02* (2013.01); *C22C 21/04* (2013.01); *C22C 21/14* (2013.01); *C22C 21/16* (2013.01); *F02F 2200/06* (2013.01)

(58) Field of Classification Search
CPC ..... C22C 21/02; C22C 21/04; F02F 3/0084
See application file for complete search history.

(56) References Cited

U.S. PATENT DOCUMENTS

| | | | | |
|---|---|---|---|---|
| 4,648,918 | A * | 3/1987 | Asano | C22C 21/02 148/417 |
| 5,250,125 | A | 10/1993 | Koch et al. | |
| 2004/0057865 | A1 | 3/2004 | Ikuno et al. | |
| 2009/0220376 | A1 | 9/2009 | Kernig et al. | |
| 2012/0164021 | A1* | 6/2012 | Dragulin | C22C 1/06 420/532 |
| 2013/0115129 | A1 | 5/2013 | Xing et al. | |
| 2016/0271687 | A1 | 9/2016 | Morgenstern et al. | |

FOREIGN PATENT DOCUMENTS

| | | | | |
|---|---|---|---|---|
| CN | 101294875 | A | 10/2008 | |
| CN | 103003458 | A | 3/2013 | |
| DE | 4404420 | A1 * | 8/1995 | C22C 21/02 |
| DE | 4404420 | A1 | 8/1995 | |

(Continued)

OTHER PUBLICATIONS

Major, Fred. "Aluminum and Aluminum Castings", ASM Handbook vol. 15: Castings, ASM International, pp. 1059-1084, DOI: https://doi.org/10.31399/asm.hb.v15.9781627081870. (Year: 2008).*
Japan Aluminum Association, Mold and Die Casting, The metallic material to be utilized at site, Aluminum, Inc. Industry Research Council, Kogyo Chosakai Publishing Co., Ltd., Nov. 9, 2007, pp. 222-225.
International Search Report, dated Jul. 17, 2015 (PCT/EP2015/060319).
Vogel, "Schafer Chemische Fabrik GmbH-Feinung von primar erstarrtem Silizium in ubereutektischen Legierungen." Giesserei Praxis 6 (2008): pp. 231-233.
Hasse, Giesserei Lexikon, 19th Edition, Schiele & Schon, 2008, pp. 136, 934-935.
Ilschner, Werkstoff-wissenschaften: Eigenschaften, Vorgange, Technologien, Zweite, verbesserte Auflage, Mit 181 Abbildungen und 26 Tabellen, Springer-Verlag, 1990, p. 133.

(Continued)

*Primary Examiner* — George Wyszomierski
*Assistant Examiner* — Janell C Morillo
(74) *Attorney, Agent, or Firm* — Robert L. Stearns; Dickinson Wright, PLLC

(57) ABSTRACT

The invention relates to a method for producing an engine component, in particular a piston for an internal combustion engine, wherein an aluminum alloy is cast in the gravity die casting process and wherein the aluminum alloy has 7 to <14.5 wt % silicon, >1.2 to ≤4 wt % nickel, >3.7 to <10 wt % copper, <1 wt % cobalt, 0.1 to 1.5 wt % magnesium, 0.1 to ≤0.7 wt % iron, 0.1 to ≤0.7 wt % manganese, >0.1 to <0.5 wt % zirconium, ≥0.1 to ≤0.3 wt % vanadium, 0.05 to 0.5 wt % titanium, and 0.004 to ≤0.05 wt % phosphorus as alloying elements and aluminum and unavoidable contaminants as the remainder. The aluminum alloy can optionally comprise beryllium, wherein the calcium content is limited to a low level. The invention further relates to an engine component, in particular a piston for an internal combustion engine, wherein the engine component is composed at least partially of an aluminum alloy, and to the use of an aluminum alloy to produce an engine component, in particular a piston of an internal combustion engine.

28 Claims, No Drawings

(56) References Cited

FOREIGN PATENT DOCUMENTS

| | | | | |
|---|---|---|---|---|
| DE | 10333103 | B4 | | 9/2009 |
| DE | 102011083968 | A1 | | 4/2013 |
| DE | 102011083969 | A1 | | 4/2013 |
| DE | 102011083972 | A1 | | 4/2013 |
| EP | 0539328 | A | | 4/1993 |
| EP | 0924310 | A1 | | 6/1999 |
| EP | 1340827 | B1 | | 11/2004 |
| EP | 1820866 | A1 | | 8/2007 |
| EP | 1975262 | B1 | | 10/2008 |
| EP | 1978120 | B1 | | 6/2012 |
| JP | 08104937 | A | * | 4/1996 |
| JP | H08104937 | A | | 4/1996 |
| JP | H10226840 | A | | 8/1998 |
| JP | 2004256873 | A | | 9/2004 |
| JP | 2006316725 | A | | 11/2006 |
| JP | 2013194261 | A | | 9/2013 |
| JP | 2014109045 | A | | 6/2014 |
| WO | 0071767 | A1 | | 11/2000 |
| WO | 2010025919 | A2 | | 3/2010 |
| WO | 2012008470 | A1 | | 1/2012 |
| WO | 2013050358 | A1 | | 4/2013 |
| WO | 2014076174 | A1 | | 5/2015 |

OTHER PUBLICATIONS

Floweday et al., Thermo-mechanical fatigue damage and failure of modern high performance diesel pistons, Engineering Failure Analysis, vol. 18, Feb. 2, 2011, pp. 1664-1674.

Holleman et al., Lehrbuch der anorganischen Chemie, Berlin/New York 2007, pp. 1433-1440, Chapter 22, Copper purity.

Maschinenbau-Wissen.de, 2009, https://www.maschinenbau-wissen.de/skript3/werkstofftechnik/aluminium/75-reines-aluminium, retrieved Dec. 3, 2020, Aluminum purity.

Smart Elements—High pure Black Phosphorus—large crystals—1000 mg, https://www.smart-elements.com/shop/high-pure-black-phosphorus-large-crystals-1000-mg/, retrieved Dec. 3, 2020.

Smart Elements—High pure Black Phosphorus—single crystals—3—12mm, https://www.smart-elements.com/shop/high-pure-black-phosphorus-single-crystals-3-12mm/, retrieved Dec. 3, 2020.

Gießerei-Lexikon 2019, Schiele & Schön GmbH (Mar. 1, 2019), ISBN 978-3794909162, Primary Silicon.

* cited by examiner

METHOD FOR PRODUCING AN ENGINE COMPONENT, ENGINE COMPONENT, AND USE OF AN ALUMINUM ALLOY

BACKGROUND

1. Technical Field

The present invention relates to a method for producing and using an engine component, in particular a piston for an internal combustion engine, wherein an aluminum alloy is cast in the gravity die casting process, to an engine component consisting, at least in part, of an aluminum alloy, and to the use of an aluminum alloy to produce such an engine component.

2. Background Art

In the past few years, there has been a growing demand for particularly economic and, thus, ecological means of transportation which must meet high consumption and emission requirements. In addition, there has always been a need to design engines with the highest possible performance and fuel efficiency. A key factor in the development of high-performance and low-emission internal combustion engines are pistons that can be used at ever-increasing combustion temperatures and combustion pressures, which is made possible essentially by ever more efficient piston materials.

A piston for an internal combustion engine must, in principle, exhibit high heat resistance while being as lightweight and strong as possible. It is of great significance thereby how the microstructural distribution, morphology, composition and thermal stability of highly heat-resistant phases are designed. Optimization in this regard usually allows for a minimum of pores and oxide inclusions to be contained.

The sought-for material must be optimized both in terms of isothermal vibration resistance (HCF) and thermo-mechanical fatigue strength (TMF). To achieve an optimal TMF, the finest possible microstructure of the material should be striven for. A fine microstructure reduces the risk of microplasticity or microcracks developing on relatively large primary phases (particularly on primary silicon precipitates) and thus also reduces the risk of crack initiation and crack propagation.

Microplasticities or microcracks, which may considerably lower the service life of the piston material, are induced on relatively large primary phases, notably primary silicon precipitates, when these are exposed to TMF stress, owing to different expansion coefficients of the individual components of the alloy, namely the matrix and the primary phases. It is known that primary phases should be kept as small as possible to increase service life.

When the gravity die casting process is used, there is an upper concentration limit up to which alloying elements should be included and beyond which the castability of the alloy is reduced or casting becomes impossible. In addition, excessive concentrations of strength-increasing elements give rise to the formation of large, plate-like intermetallic phases which drastically reduce fatigue strength.

DE 44 04 420 A1 describes an alloy which can be used, in particular, for pistons and components that are subject to high temperatures and high mechanical loads. The described aluminum alloy includes 8.0 to 10.0 wt % silicon, 0.8 to 2.0 wt % magnesium, 4.0 to 5.9 wt % copper, 1.0 to 3.0 wt % nickel, 0.2 to 0.4 wt % manganese, less than 0.5 wt % iron, as well as at least one element selected from antimony, zirconium, titanium, strontium, cobalt, chromium and vanadium, wherein at least one of these elements is present in an amount of >0.3 wt % and wherein the sum of these elements is <0.8 wt %.

EP 0 924 310 B1 describes an aluminum-silicon alloy for use in the production of pistons, in particular for pistons in internal combustion engines. The aluminum alloy has the following composition: 10.5 to 13.5 wt % silicon, 2.0 to less than 4.0 wt % copper, 0.8 to 1.5 wt % magnesium, 0.5 to 2.0 wt % nickel, 0.3 to 0.9 wt % cobalt, at least 20 ppm phosphorus and either 0.05 to 0.2 wt % titanium or up to 0.2 wt % zirconium and/or up to 0.2 wt % vanadium, and the remainder aluminum and unavoidable impurities.

WO 00/71767 A1 describes an aluminum alloy that is suitable for use in high-temperature applications such as, for example, highly loaded pistons or other applications in internal combustion engines. The aluminum alloy is composed of the following elements: 6.0 to 14.0 wt % silicon, 3.0 to 8.0 wt % copper, 0.01 to 0.8 wt % iron, 0.5 to 1.5 wt % magnesium, 0.05 to 1.2 wt % nickel, 0.01 to 1.0 wt % manganese, 0.05 to 1.2 wt % titanium, 0.05 to 1.2 wt % zirconium, 0.05 to 1.2 wt % vanadium, 0.001 to 0.10 wt % strontium, and the remainder aluminum.

DE 103 33 103 B4 describes a piston made of an aluminum casting alloy, wherein said aluminum casting alloy contains: 0.2 or less wt. % magnesium, 0.05 to 0.3% by mass of titanium, 10 to 21 wt % silicon, 2 to 3.5 wt % copper, 0.1 to 0.7 wt % iron, 1 to 3 wt % nickel, 0.001 to 0.02 wt % phosphorus, 0.02 to 0.3 wt % zirconium, and the remainder aluminum and impurities. It is moreover described that the size of a non-metallic inclusion present inside the piston is less than 100 μm.

EP 1 975 262 B1 describes an aluminum casting alloy consisting of: 6 to 9% silicon, 1.2 to 2.5% copper, 0.2 to 0.6% magnesium, 0.2 to 3% nickel, 0.1 to 0.7% iron, 0.1 to 0.3% titanium, 0.03 to 0.5% zirconium, 0.1 to 0.7% manganese, 0.01 to 0.5% vanadium, and one or more of the following elements: strontium 0.003 to 0.05%, antimony 0.02 to 0.2%, and sodium 0.001 to 0.03%, wherein the total amount of titanium and zirconium is less than 0.5% and the remainder is made up of aluminum and unavoidable impurities when the total amount is considered to be 100 mass %.

WO 2010/025919 A2 describes a method for producing a piston of an internal combustion engine, wherein a piston blank is cast from an aluminum-silicon alloy with added copper amounts and is then finished. The invention provides that the copper content does not exceed 5.5% of the aluminum-silicon alloy and that amounts of titanium (Ti), zirconium (Zr), chromium (Cr) and/or vanadium (V) are admixed to the aluminum-silicon alloy, with the sum of all constituents equaling 100%.

The application DE 102011083969 relates to a method for producing an engine component, in particular a piston for an internal combustion engine, wherein an aluminum alloy is cast in the gravity die casting process, to an engine component consisting, at least in part, of an aluminum alloy, and to the use of an aluminum alloy to produce an engine component. Here, the aluminum alloy includes the following alloying elements: 6 to 10 wt % silicon, 1.2 to 2 wt % nickel, 8 to 10 wt % copper, 0.5 to 1.5 wt % magnesium, 0.1 to 0.7 wt % iron, 0.1 to 0.4 wt % manganese, 0.2 to 0.4 wt % zirconium, 0.1 to 0.3 wt % vanadium, 0.1 to 0.5 wt % titanium, and the remainder aluminum and unavoidable impurities. This alloy preferably has a phosphorus content of less than 30 ppm.

In conclusion, EP 1 340 827 B1 can be mentioned which describes the effects of beryllium in an aluminum-silicon casting alloy having a relatively low concentration of magnesium. Additions of 5 to 100 ppm beryllium contribute to the formation of an advantageous, thin, stoichiometric MgO layer which promotes the fluidity and short-term oxidation behavior of the alloy.

SUMMARY OF THE INVENTION

It is an object of the present invention to provide a method for producing an engine component, in particular a piston for an internal combustion engine, wherein an aluminum alloy is cast in the gravity die casting process, such that a highly heat-resistant engine component can be produced in the gravity die casting process.

Another object of the invention is to provide an engine component, in particular a piston for an internal combustion engine, which is highly heat-resistant while being composed, at least in part, of an aluminum alloy.

In a method according to the invention, the aluminum alloy includes the following alloying elements:

silicon (Si) from about 7, preferably from about 9 wt %, to <about 14.5, preferably to <about 12, more preferably to <about 10.5, and even more preferably to <about 10 wt %;

nickel (Ni) from >about 1.2, preferably from >about 2 wt %, to ≤about 4, preferably to <about 3.5, and more preferably to <about 2 wt %;

copper (Cu) from >about 3.7, preferably from >about 5.2, and more preferably from >5.5 wt %, to <about 10, preferably to <about 8, more preferably to ≤about 5.5, and even more preferably to about 5.2 wt %;

cobalt (Co) of up to <about 1 wt %, preferably from >about 0.2 wt % to <about 1 wt %;

magnesium (Mg) from about 0.1, preferably from about 0.5, more preferably from about 0.6, even more preferably from >about 0.65, and particularly preferred ≥about 1.2, to about 1.5, preferably to about 1.2 wt %, and more preferably to ≤about 0.8 wt. %;

iron (Fe) from about 0.1, preferably from about 0.4 wt %, to ≤about 0.7, preferably to about 0.6 wt %;

manganese (Mn) from about 0.1 wt % to ≤about 0.7, and preferably to about 0.4 wt. %;

zirconium (Zr) from >about 0.1, preferably from about >0.2 wt %, to <about 0.5, preferably to ≤about 0.4, and more preferably to <about 0.2 wt %;

vanadium (V) from ≥about 0.1 wt % to ≤about 0.3, preferably to <about 0.2 wt %;

titanium (Ti) from about 0.05, preferably from about 0.1 wt %, to about 0.5, preferably to ≤about 0.2 wt %;

phosphorus (P) from about 0.004 wt % to about ≤0.05, preferably to about 0.008 wt %, and the remainder aluminum and unavoidable impurities. Other elements not mentioned above can also be considered as impurities. The impurity level may, for example, amount to 0.01 wt % per impurity element or 0.2 wt % in total.

The selected aluminum alloy makes it possible to produce an engine component in the gravity die casting process which has a high content of finely dispersed, highly heat-resistant, thermally stable phases as well as a fine microstructure. The selection of the alloy according to the invention reduces susceptibility to crack initiation and crack propagation, for example on oxides or primary phases, and increases the TMF-HCF service life as compared to hitherto known processes for producing pistons and similar engine components.

At least in a piston produced according to the invention, the alloy according to the invention, and more particularly the comparatively low silicon content, also allows comparatively less and finer primary silicon to be present in the bowl rim area of the piston, which is subject to high thermal load, such that the alloy results in particularly good properties of a piston produced according to the invention. Thus, a highly heat-resistant engine component can be produced in the gravity die casting process. The amounts according to the invention of copper, zirconium, vanadium and titanium, and more particularly the comparatively high zirconium, vanadium and titanium content, result in an advantageous proportion of strength-increasing precipitates, without, however, giving rise to large, plate-like intermetallic phases. It is possible, for example, to optimize the alloy properties for a specific application by targetedly selecting the Cu content within the range according to the invention. Higher Cu contents particularly improve the heat resistance of the alloy. Lower contents, on the other hand, allow the heat conductivity to be increased and the density of the alloy to be reduced. Furthermore, the amounts according to the invention of cobalt and phosphorus are advantageous in that cobalt increases the hardness and (thermal) strength of the alloy, and phosphorus, as a nucleating agent for primary silicon precipitates, contributes to these being precipitated in a particularly fine and uniformly dispersed manner. Zirconium and cobalt moreover contribute to an increase in strength at elevated temperatures, particularly in the bowl rim area.

In an advantageous manner, the aforementioned aluminum alloys preferably include 0.6 wt % to 0.8 wt. % magnesium which, in the preferred concentration range, particularly contributes to the efficient formation of secondary, strength-increasing phases, without there being an excessive formation of oxides. Alternatively or additionally, the alloy preferably further includes 0.4 wt % to 0.6 wt % iron which advantageously reduces the tendency of the alloy to stick in the casting die, with the formation of plate-like phases being limited in the aforementioned concentration range.

The aluminum alloys described above may further contain from about 0.0005, preferably from >about 0.006, and more preferably from about 0.01 wt %, to about 0.5, preferably to about <0.1 wt % beryllium (Be), with the calcium content being limited to ≤about 0.0005 wt %. The addition of beryllium results in a particularly good castability of the alloy. The addition thereof to the melt produces a thick oxide skin on the melt which functions as a diffusion barrier and reduces oxidation and hydrogen uptake of the melt. Also, it is possible therewith to prevent the diffusion of aluminum and magnesium to the outside. The above effects are particularly relevant when holding furnaces are used. In addition, a fine/thin oxide layer which improves fluidity is formed at the solidification front during casting, for example in a die. As a whole, therefore, thin walls and finely shaped structures can be filled better and without any additional auxiliary measures. The addition of beryllium additionally improves the strength characteristics of the alloy as a whole. During aging, a higher density can be achieved on strength-increasing precipitates. The addition of beryllium supplements the advantageous effects of the present aluminum alloys by decreasing the oxidation of the melt, and contributes to improved castability, particularly in the gravity die casting procedure, and improves the strength of the alloy. At the same time, it is preferred that the calcium content be limited to the above low level. The simultaneous presence of higher amounts of calcium may counteract the advantageous effects of beryllium and may enhance oxidation. The lowest possible calcium content is advantageous in this regard.

Particularly preferred aluminum alloys A, B, C and D of the present invention can be seen from the following table (figures in wt %):

| Composition | | A | B | C | D |
|---|---|---|---|---|---|
| Si | min | 9 | 9 | 9 | 7 |
| | max | <10.5 | <10.5 | <12 | <14.5 |
| Ni | min | >2.0 | >1.2 | 2 | |
| | max | <3.5 | <2.0 | <3.5 | ≤4 |
| Cu | min | >5.2 | >5.2 | >3.7 | |
| | max | <10 | <10 | 5.2 | ≤5.5 |
| Co | min | | | | |
| | max | <1 | <1 | <1 | <1 |
| Mg | min | 0.5 | 0.5 | 0.5 | 0.1 |
| | max | 1.5 | 1.5 | 1.5 | 1.2 |
| Fe | min | 0.1 | 0.1 | 0.1 | |
| | max | 0.7 | 0.7 | 0.7 | ≤0.7 |
| Mn | min | 0.1 | 0.1 | 0.1 | |
| | max | 0.4 | 0.4 | 0.4 | ≤0.7 |
| Zr | min | 0.2 | 0.2 | 0.2 | >0.1 |
| | max | <0.4 | <0.4 | 0.4 | <0.5 |
| V | min | >0.1 | >0.1 | 0.1 | |
| | max | <0.2 | <0.2 | 0.3 | ≤0.3 |
| Ti | min | 0.05 | 0.05 | 0.1 | |
| | max | <0.2 | <0.2 | 0.5 | ≤0.2 |
| P | min | 0.004 | 0.004 | 0.004 | |
| | max | 0.008 | 0.008 | 0.008 | ≤0.05 |
| Be | min | — | — | — | 0.0005 |
| | max | — | — | — | 0.5 |
| Ca | min | — | — | — | |
| | max | — | — | — | ≤0.0005 |
| Remainder | | Al and unavoidable impurities | | | |

Alloys A, B, C and D realize the aforementioned technical advantages. In addition, the comparatively high content of Cu and Zr in alloy A proves advantageous in that it increases the level of strength-increasing precipitates. The same applies for the preferred alloy B which, due to having a reduced nickel content, moreover helps reduce the costs of the alloy. The comparatively high content of Zr, V and Ti in alloy C also additionally contributes to increasing the level of strength-increasing precipitates. An increased content of Zr generally brings about a further improvement in strength. It is particularly preferred for alloy C to have a Si content of <10.5 wt %. Alloy D is advantageous in that the addition of beryllium improves, as described above, the oxidation and flow properties of the melt as well as the strength of the alloy. This effect is enhanced even further by the comparatively low content of Mg and the content of Ca which is limited to a low level. Alloy D may, in addition, include the alloying elements in the following preferred concentration ranges: nickel (Ni) from about 2 to <about 3.5 wt %, copper (Cu) from >about 3.7 to about 5.2 wt %, magnesium (Mg) from >about 0.65 to <about 0.8 wt %, iron (Fe) from about 0.4 to about 0.6 wt %, manganese (Mn) from about 0.1 to about 0.4 wt %, and as regards beryllium, the aforementioned preferred concentration limits. The presence/addition of beryllium in/to the alloys A, B and C is optionally also possible in order to improve the oxidation, flow and strength properties. Here, the calcium content should also be limited to the specified low level in order not to counteract the advantageous effects of beryllium. As a whole, the alloys A, B, C and D can be combined to a certain extent, and therefore, the advantageous technical effects thereof can also be realized together in one single alloy.

Advantageously, the weight ratio of iron to manganese in the aforementioned aluminum alloys is no more than 5:1, preferably about 2.5:1. In this embodiment, the aluminum alloy thus contains no more than five parts of iron for one part of manganese, preferably about 2.5 parts of iron for one part of manganese. Owing to this ratio, particularly advantageous strength characteristics of the engine component are achieved.

It is particularly preferred that the nickel concentration be <3.5 wt % since otherwise excessively large, plate-shaped (primary, nickel-rich) phases may form in the structure which, owing to their notch effect, may reduce strength and/or service life. At the preferred nickel concentrations of >1.2 wt %, a thermally stable network of primary phases having connectivity and contiguity is produced.

It is furthermore preferred that the sum of nickel and cobalt in the aforementioned aluminum alloys be >2.0 wt % and <3.8 wt %. The lower limit ensures an advantageous strength of the alloy, and the upper limit advantageously guarantees a fine microstructure and avoids the formation of coarse, plate-shaped phases which would reduce strength.

The aluminum alloys advantageously exhibit a fine microstructure with a low content of pores and inclusions and/or few and small primary silicon, particularly in the highly loaded bow rim area. In this regard, a low content of pores must preferably be understood as meaning a porosity of <0.01, and few primary silicon as meaning <1%. Furthermore, the fine microstructure is advantageously described in that the average length of the primary silicon is about <5 μm and its maximum length is about <10 μm, with the intermetallic phases and/or primary precipitates having lengths of about <30 μm and no more than <50 μm on average. The fine microstructure particularly contributes to improving the thermomechanical fatigue strength. Limiting the size of the primary phases may reduce the susceptibility to crack initiation and crack propagation and may thus significantly increase the TMF-HCF service life. Owing to the notch effect of pores and inclusions, it is moreover particularly advantageous to keep the content thereof as low as possible.

An engine component according to the invention consists, at least in part, of one of the aforementioned aluminum alloys. Another independent aspect of the invention is the use of the aforementioned aluminum alloys to produce an engine component, in particular a piston of an internal combustion engine, according to claim 19 and the corresponding sub-claim. The found aluminum alloys are processed, in particular, in the gravity die casting process.

The invention claimed is:

1. An engine component which consists, at least in part, of an aluminum alloy, said aluminum alloy including the following alloying elements:

| | |
|---|---|
| silicon: | 7 wt. % to <14.5 wt %, |
| nickel: | >1.2 wt % to ≤4 wt %, |
| copper: | >3.7 wt % to <10 wt %, |
| cobalt: | up to <1 wt %, |
| magnesium: | 0.1 wt % to 1.5 wt %, |
| iron: | 0.1 wt % to ≤0.7 wt %, |
| manganese: | 0.1 wt % to ≤0.7 wt %, |
| zirconium: | 0.2 wt % to <0.5 wt % |
| vanadium: | ≥0.1 wt % to ≤0.3 wt % |
| titanium: | 0.05 wt % to 0.5 wt % |
| phosphorus: | 0.004 wt % to ≤0.05 wt %, |
| optionally beryllium: | 0.0005 wt % to 0.5 wt %, and |
| optionally calcium: | up to ≤0.0005 wt %, |

and the remainder aluminum and unavoidable impurities.

2. The engine component according to claim 1, wherein the aluminum alloy further includes:

| | |
|---|---|
| beryllium: | 0.0005 wt % to 0.5 wt %, and |
| calcium: | up to ≤0.0005 wt %. |

3. The engine component according to claim 1, wherein the aluminum alloy includes:

| | |
|---|---|
| silicon: | 9 wt. % to <10.5 wt %, |
| nickel: | >2 wt % to <3.5 wt %, |
| copper: | >5.2 wt % to <10 wt %, |
| cobalt: | up to <1 wt %, |
| magnesium: | 0.5 wt % to 1.5 wt %, |
| iron: | 0.1 wt % to 0.7 wt %, |
| manganese: | 0.1 wt % to 0.4 wt %, |
| zirconium: | 0.2 wt % to <0.4 wt % |
| vanadium: | >0.1 wt % to <0.2 wt % |
| titanium: | 0.05 wt % to <0.2 wt % |
| phosphorus: | 0.004 wt % to 0.008 wt %, |

and the remainder aluminum and unavoidable impurities.

4. The engine component according to claim 1, wherein the aluminum alloy includes:

| | |
|---|---|
| silicon: | 9 wt. % to <10.5 wt %, |
| nickel: | >1.2 wt % to <2.0 wt %, |
| copper: | >5.2 wt % to <10 wt %, |
| cobalt: | up to <1 wt %, |
| magnesium: | 0.5 wt % to 1.5 wt %, |
| iron: | 0.1 wt % to 0.7 wt %, |
| manganese: | 0.1 wt % to 0.4 wt %, |
| zirconium: | 0.2 wt % to <0.4 wt % |
| vanadium: | >0.1 wt % to <0.2 wt % |
| titanium: | 0.05 wt % to <0.2 wt % |
| phosphorus: | 0.004 wt % to 0.008 wt %, |

and the remainder aluminum and unavoidable impurities.

5. The engine component according to claim 1, wherein the aluminum alloy includes:

| | |
|---|---|
| silicon: | 9 wt. % to <12 wt %, |
| nickel: | 2 wt % to <3.5 wt %, |
| copper: | >3.7 wt % to 5.2 wt %, |
| cobalt: | up to <1 wt %, |
| magnesium: | 0.5 wt % to 1.5 wt %, |
| iron: | 0.1 wt % to 0.7 wt %, |
| manganese: | 0.1 wt % to 0.4 wt %, |
| zirconium: | 0.2 wt % to 0.4 wt % |
| vanadium: | 0.1 wt % to 0.3 wt % |
| titanium: | 0.1 wt % to 0.5 wt % |
| phosphorus: | 0.004 wt % to 0.008 wt %, |

and the remainder aluminum and unavoidable impurities.

6. The engine component according to claim 1, wherein the aluminum alloy includes:

| | |
|---|---|
| silicon: | 7 wt. % to <14.5 wt %, |
| nickel: | >1.2 wt % to ≤4 wt %, |
| copper: | >3.7 wt % to ≤5.5 wt %, |
| cobalt: | up to <1 wt %, |
| magnesium: | 0.1 wt % to 1.2 wt %, |
| iron: | 0.1 wt % to ≤0.7 wt %, |
| manganese: | 0.1 wt % to ≤0.7 wt %, |
| zirconium: | 0.2 wt % to <0.5 wt % |
| vanadium: | ≥0.1 wt % to ≤0.3 wt % |
| titanium: | 0.05 wt % to ≤0.2 wt % |
| phosphorus: | 0.004 wt % to ≤0.05 wt %, |
| beryllium: | 0.0005 wt % to 0.5 wt %, |
| calcium: | up to ≤0.0005 wt %, |

and the remainder aluminum and unavoidable impurities.

7. The engine component according to claim 1, wherein in the aluminum alloy a weight ratio of iron to manganese is no more than 5:1.

8. The engine component according to claim 1, wherein a sum of nickel and cobalt is >2.0 wt % and <3.8 wt %.

9. The engine component according to claim 1, wherein the aluminum alloy has a porosity <0.01% and/or a content of primary silicon <1%, said primary silicon, if present, having.

10. The engine component of claim 1, comprising a piston.

11. The engine component of claim 1, wherein the weight ratio of iron to manganese is about 2.5 to 1.

12. The engine component of claim 9, wherein the aluminum alloy is present in a bowl rim area of the component.

13. The engine component according to claim 1, wherein the aluminum alloy includes intermetallic phases and/or primary precipitates, and the intermetallic phases and/or primary precipitates have maximum lengths of <50 μm.

14. The engine component according to claim 1, wherein the aluminum alloy includes cobalt in an amount of greater than 0.2 wt %.

15. A method for producing an engine component, wherein an aluminum alloy is cast in a gravity die casting process, said aluminum alloy including the following alloying elements:

| | |
|---|---|
| silicon: | 7 wt. % to <14.5 wt %, |
| nickel: | >1.2 wt % to ≤4 wt %, |
| copper: | >3.7 wt % to <10 wt %, |
| cobalt: | up to <1 wt %, |
| magnesium: | 0.1 wt % to 1.5 wt %, |
| iron: | 0.1 wt % to ≤0.7 wt %, |
| manganese: | 0.1 wt % to ≤0.7 wt %, |
| zirconium: | 0.2 wt % to <0.5 wt % |
| vanadium: | ≥0.1 wt % to ≤0.3 wt % |
| titanium: | 0.05 wt % to 0.5 wt % |
| phosphorus: | 0.004 wt % to ≤0.05 wt % |
| optionally beryllium: | 0.0005 wt % to 0.5 wt %, and |
| optionally calcium: | up to ≤0.0005 wt %, |

and the remainder aluminum and unavoidable impurities.

16. The method according to claim 15, wherein the aluminum alloy further includes:

| | |
|---|---|
| beryllium: | 0.0005 wt. % to 0.5 wt %, and |
| calcium: | up to ≤0.0005 wt %. |

17. The method according to claim 16, wherein the content of primary silicon in the aluminium alloy is <1% of the aluminium alloy.

18. The method according to claim 17, wherein said primary silicon has lengths of <5 μm on average and/or maximum lengths of <10 μm.

19. The method according to claim 16, wherein intermetallic phases and/or primary precipitates in the aluminium alloy have lengths of <30 μm on average and/or maximum lengths of <50 μm.

20. The method according to claim 15, wherein the aluminum alloy includes:

| | |
|---|---|
| silicon: | 9 wt. % to <10.5 wt %, |
| nickel: | >2 wt % to <3.5 wt %, |
| copper: | >5.2 wt % to <10 wt %, |
| cobalt: | up to <1 wt %, |

-continued

| | |
|---|---|
| magnesium: | 0.5 wt % to 1.5 wt %, |
| iron: | 0.1 wt % to 0.7 wt %, |
| manganese: | 0.1 wt % to 0.4 wt %, |
| zirconium: | 0.2 wt % to <0.4 wt % |
| vanadium: | >0.1 wt % to <0.2 wt % |
| titanium: | 0.05 wt % to <0.2 wt % |
| phosphorus: | 0.004 wt % to 0.008 wt %, |

and the remainder aluminum and unavoidable impurities.

21. The method according to claim 15, wherein the aluminum alloy includes:

| | |
|---|---|
| silicon: | 9 wt. % to <10.5 wt %, |
| nickel: | >1.2 wt % to <2.0 wt %, |
| copper: | >5.2 wt % to <10 wt %, |
| cobalt: | up to <1 wt %, |
| magnesium: | 0.5 wt % to 1.5 wt %, |
| iron: | 0.1 wt % to 0.7 wt %, |
| manganese: | 0.1 wt % to 0.4 wt %, |
| zirconium: | 0.2 wt % to <0.4 wt % |
| vanadium: | >0.1 wt % to <0.2 wt % |
| titanium: | 0.05 wt % to <0.2 wt % |
| phosphorus: | 0.004 wt % to 0.008 wt %, |

and the remainder aluminum and unavoidable impurities.

22. The method according to claim 15, wherein the aluminum alloy includes:

| | |
|---|---|
| silicon: | 9 wt. % to <12 wt %, |
| nickel: | 2 wt % to <3.5 wt %, |
| copper: | >3.7 wt % to 5.2 wt %, |
| cobalt: | up to <1 wt %, |
| magnesium: | 0.5 wt % to 1.5 wt %, |
| iron: | 0.1 wt % to 0.7 wt %, |
| manganese: | 0.1 wt % to 0.4 wt %, |

-continued

| | |
|---|---|
| zirconium: | 0.2 wt % to 0.4 wt % |
| vanadium: | 0.1 wt % to 0.3 wt % |
| titanium: | 0.1 wt % to 0.5 wt % |
| phosphorus: | 0.004 wt % to 0.008 wt %, |

and the remainder aluminum and unavoidable impurities.

23. The method according to claim 15, wherein the aluminum alloy includes:

| | |
|---|---|
| silicon: | 7 wt. % to <14.5 wt %, |
| nickel: | >1.2 wt % to ≤4 wt %, |
| copper: | >3.7 wt % to ≤5.5 wt %, |
| cobalt: | up to <1 wt %, |
| magnesium: | 0.1 wt % to 1.2 wt %, |
| iron: | 0.1 wt % to ≤0.7 wt %, |
| manganese: | 0.1 wt % to ≤0.7 wt %, |
| zirconium: | 0.2 wt % to <0.5 wt % |
| vanadium: | ≥0.1 wt % to ≤0.3 wt % |
| titanium: | 0.05 wt % to ≤0.2 wt % |
| phosphorus: | 0.004 wt % to ≤0.05 wt %, |
| beryllium: | 0.0005 wt % to 0.5 wt %, |
| calcium: | up to ≤0.0005 wt %, |

and the remainder aluminum and unavoidable impurities.

24. The method according to claim 15, wherein in the aluminum alloy a weight ratio of iron to manganese is no more than about 5:1.

25. The method according to claim 24, wherein the weight ratio of iron to manganese is about 2.5 to 1.

26. The method according to claim 15, wherein a sum of nickel and cobalt is >2.0 wt % and <3.8 wt %.

27. The method according to claim 16, wherein the aluminum alloy has a porosity of <0.01%.

28. The method according to claim 15, wherein the engine component is a piston.

* * * * *